United States Patent [19]

Uehara et al.

[11] 4,245,962

[45] Jan. 20, 1981

[54] DISPLACEMENT CONTROL SYSTEM FOR VARIABLE DISPLACEMENT PUMP

[75] Inventors: Kazuo Uehara, Tokyo; Hideaki Toma, Yokohama; Yoshito Sato, Hirakata, all of Japan

[73] Assignee: Kabushiki Kaisha Komatsu Seisakusho, Tokyo, Japan

[21] Appl. No.: 52,099

[22] Filed: Jun. 26, 1979

[30] Foreign Application Priority Data

Jun. 26, 1978 [JP] Japan ..... 53/86674[U]

[51] Int. Cl.[3] ..... F04B 49/00

[52] U.S. Cl. ..... 417/218

[58] Field of Search ..... 417/218, 222; 60/444, 60/445, 447, 449

[56] References Cited

U.S. PATENT DOCUMENTS

| | | | |
|---|---|---|---|
| 3,797,245 | 3/1974 | Hein | 60/452 |
| 3,830,594 | 8/1974 | Hein et al. | 417/217 |
| 3,935,707 | 2/1976 | Murphy et al. | 60/444 |

*Primary Examiner*—Leonard D. Christian

*Attorney, Agent, or Firm*—Armstrong, Nikaido, Marmelstein & Kubovcik

[57] ABSTRACT

A displacement control system for a variable displacement pump comprising a charge pump; a cut-off control valve connected to the charge pump, the cut-off control valve including a valve body having a first and a second pump ports and an outlet port formed therein, the first pump port being connected to the charge pump and the second pump port being connected to the variable displacement pump, a sleeve mounted within the valve body, a pin slidably mounted within the sleeve, a spool slidably mounted within the sleeve, a cylindrical cap member fixedly secured to the valve body defining a spring chamber therein, and a spring disposed within the spring chamber for urging the spool toward connecting the first pump port with the outlet port; and a servo booster connected to the outlet port for controlling the displacement of the variable displacement pump.

5 Claims, 6 Drawing Figures

DISPLACEMENT CONTROL SYSTEM FOR VARIABLE DISPLACEMENT PUMP

BACKGROUND OF THE INVENTION

This invention relates to a cut-off control system for variable displacement pumps and more particularly to a control system for preventing the generation of excessive pressure by reducing the displacement volume of such pumps.

In conventional control devices of the type specified, the arrangement is made such that when the delivery pressure of the pump has become more than a predetermined cut-off pressure set by a spring of a cut-off control valve, the spool thereof is urged against the biasing force of the spring so that the pump pressure is transmitted to the chamber of a variable displacement device so as to urge a piston mechanically connected to the variable displacement pump thereby reducing the delivery volume of the pump.

In this conventional system, there are following problems.

(1) Improvement in response to control system renders the system unstable. Such unstable condition is caused by overdisplacement of the variable displacement device.

(2) Because the displacement volume of the pump reaches its maximum when the pump is stopped, the prime mover for the pump cannot be easily started.

(3) Since the fluid pressure source for the control valve varies depending on the load applied, it becomes difficult to provide other types of displacement controls than the cut-off control.

SUMMARY OF THE INVENTION

It is therefore an object of the present invention to provide a displacement control system for a variable displacement pump which is capable of overcoming the above noted problems.

Another object of the present invention is to provide a displacement control system for a variable displacement pump wherein a stable and reliable displacement control can be achieved by reducing an overmovement of a servo piston due to inertia to a minimum.

A further object of the present invention is to provide a displacement control system for a variable displacement pump wherein displacement volume can be kept a minimum when a charge pump is out of operation thereby improving starting-up characteristic of a prime mover for driving the variable displacement pump.

A still further object of the present invention is to provide a displacement control system for a variable displacement pump wherein in addition to a cut-off displacement control, other types of displacement controls can be easily combined therewith.

Still another object of the present invention is to provide a displacement control system for a variable displacement pump which is capable of reducing a warming-up time for the system.

In accordance with an aspect of the present invention, there is provided a displacement control system for a variable displacement pump comprising charge pump means; cut-off control valve means connected to said charge pump means, said cut-off control valve means comprising a valve body having a first and a second pump ports and a first outlet port formed therein, the first pump port being connected to said charge pump means and the second pump port being connected to said variable displacement pump, sleeve means mounted within said valve body, a pin slidably mounted within said sleeve means, a spool slidably mounted within said sleeve means, the cross-sectional area of which is larger than that of said pin, a cylindrical cap member fixedly secured to said valve body defining a spring chamber therein, and spring means disposed within said spring chamber for urging said spool toward connecting said first pump port with said first outlet port; and servo booster means connected to said first outlet port for controlling the displacement of said variable displacement pump.

The servo booster means comprises servo pilot-operated spool valve means connected with said first outlet port and operated by the hydraulic fluid therefrom, said servo pilot-operated spool valve means being connected to said charge pump means, and servo cylinder means having a piston mounted therein, the piston being mechanically connected to said variable displacement pump for controlling the displacement therefrom. The rod-side chamber of said servo cylinder means is connected to the charge pump means and the head-side chamber thereof is connected to the servo pilot-operated spool valve means.

According to a second embodiment of the present invention, warming-up cock means is provided in the hydraulic system for reducing a warming-up time of the system when it is opened.

The above and other objects, features and advantages of the present invention will be readily apparent from the following description taken in conjunction with the accompanying drawings.

DETAILED DESCRIPTION OF THE INVENTION

Figure 1:
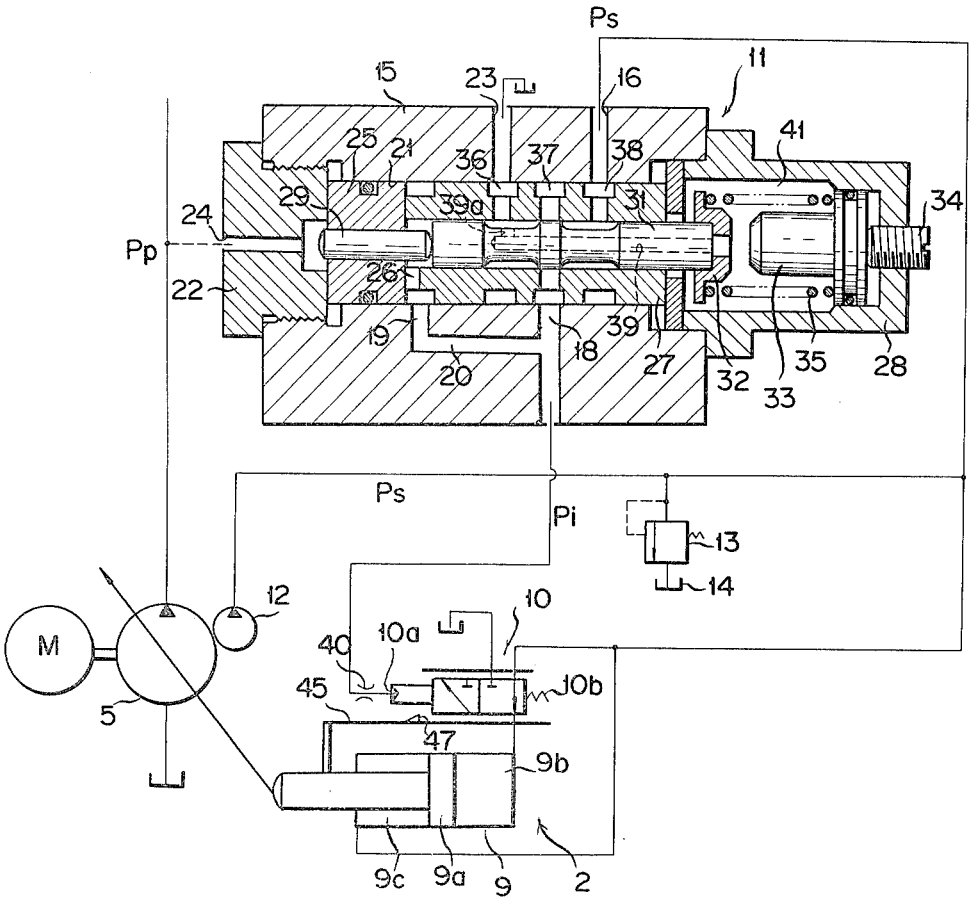
FIG. 1 is a hydraulic circuit of a displacement control system for a variable displacement pump according to the present invention wherein a cut-off control valve is shown in cross-section.

The present invention will now be described below by way of example only with reference to the accompanying drawings. Reference numeral 5 denotes a variable displacement pump the delivery side of which is connected through a selector valve to an actuator (not shown). Reference numeral 2 denotes a servo booster which adjusts the displacement of the variable displacement pump 5. The servo booster 2 comprises a servo cylinder 9 and a servo pilot spool valve 10. Reference numeral 11 indicates a cut-off control valve.

The delivery side of a charge pump 12 is connected through the servo pilot spool valve 10 to a head-side chamber 9b of the servo cylinder 9 and also directly connected to a rod-side chamber 9c of the servo cylinder 9. Reference numeral 13 denotes a relief valve which leads to a tank 14.

The above-mentioned cut-off control valve 11 has a valve body 15 having a pump port 16, outlet ports 18, 19 and a drain port 23 formed therein. The outlet port 19 communicates through a feedback circuit 20 with the outlet port 18. The valve body 15 has a bore hole 21 at one end of which is fitted a plug member 22. The plug member 22 has a pump port 24 formed therein.

Sleeves 25 and 27 are fitted in the bore hole 21. The sleeve 27 has formed therein a passage 26 communicating with the port 19. Fixedly secured to an end of the valve body 15 is a cylindrical member 28. A pin 29 is slidably mounted in the sleeve 25 and a spool 31 is slidably mounted in the sleeve 27. A spring retainer 32 is fitted to an end of the spool 31. Movably mounted in the cylindrical member 28 is a piston-shaped stopper 33. The cylindrical member 28 is provided with an adjusting screw 34 which abuts against the stopper 33. A spring 35 extends between the spring retainer 32 and the stopper 33. Spring chamber 41 communicates through a passage 39 of the spool 31 with drain.

The sleeve 27 has ports 36, 37 and 38 formed therein, and the spool 31 has a restriction 39a formed therein.

The aforementioned pump port 24 is connected to the delivery side of the variable displacement pump 5, and the pump port 16 is connected to the delivery side of the charge pump 12. The outlet port 18 communicates through a restriction 40 with an actuating port 10a of the servo pilot spool valve 10.

The operation of the present invention will now be described below.

The servo cylinder 9 includes a servo piston 9a which is mechanically connected with a yoke or swash plate (not shown) of the variable displacement pump 5. With the rightward movement of the servo piston 9, the displacement volume Q cc/Rev of the variable displacement pump 5 will increase. When the delivery pressure Pp of the variable displacement pump 5 is low, the pin 29 and the spool 31 of the cut-off control valve 11 is pushed leftwards by the force of the spring 35 so as to allow the port 16 to communicate with the port 18 so that the pilot pressure Pi becomes equal to the charge pressure Ps of the charge pump 12 set by the relief valve 13. In response to increase in the pilot pressure Pi, the spool of the pilot spool valve 10 is urged rightwards against the biasing force of the spring 10b and will assume its actuated or offset position. Consequently, the head-side chamber 9b of the servo cylinder 9 is connected to the drain, and so the servo piston 9a is move rightwards by the charge pressure Ps introduced into the rod-side chamber 9c thereby increasing the displacement volume of the variable displacement pump 5.

Since the weight of the spool of the pilot spool valve 10 is extremely light as compared with the weight of the yoke or swash plate of the variable displacement pump 5 or the weight of the servo piston 9a, the movement of the spool of the pilot spool valve 10 due to inertia can be extremely reduced.

With an increase in the pump delivery pressure Pp, the spool 31 is moved rightwards through the pin 29 against the biasing force of the spring 35 so as to cut off the communication between ports 16 and 18 and allow communication between port 18 and drain port 23 thereby lowering the pilot pressure Pi. With the lowering of the pilot pressure Pi, the pilot spool valve 10 is returned to its neutral position by the force of the spring 10b and will strike against a stop 47 which is fitted to a member 45 mechanically connecting the servo piston 9a and the pilot spool valve 10 so as to move the servo piston 9a leftwards thereby reducing the delivery volume of the variable displacement pump 5.

When the delivery pressure Pp of the pump 5 becomes low as compared with the force of the spring 35 preset by the adjusting screw 34, the spool 34 is moved to the left so as to intercommunicate the ports 16 and 18 thereby increasing the pilot pressure Pi and the displacement volume of the pump.

Because the charge pressure Ps will decrease when the charge pump 12 is stopped, the pilot pressure Pi will decrease. Consequently, as mentioned hereinabove, the servo piston 9a is moved leftwards so that the displacement volume of the pump 5 reaches its minimum. Because the charge pressure Ps will increase when the charge pump 12 is started to be driven, the pilot pressure Pi will increase and the displacement volume of the pump 5 will reach its maximum.

One of the features of the present invention resides in that the displacement volume of the variable displacement pump 5 can be controlled by the charge pressure Ps generated by the charge pump 12 which is provided separately from the pump 5 so that displacement controls other than the aforementioned cutoff control can be easily made.

If the control gain of the cut-off control valve 11 is increased in order to increase the response characteristic of the displacement control for the pump 5, the pilot pressure Pi tends to become excessively overshoot and unstable so that hunting of the variable displacement pump 5 may occur.

In order to prevent an excessive overshoot of the pilot pressure Pi, the feedback circuit 20 is provided to introduce the pilot pressure Pi between the pin 29 and the spool 31. Since the diameter of the spool 31 is larger than that of the pin 29, when the pilot pressure Pi becomes excessively high the spool 31 is moved rightwards against the biasing force of the spring 35 so as to cut off the communication between the ports 16 and 18 and allow the port 18 to communicate with the drain port 23. As a result, the pilot pressure Pi is released into the drain and the generation of excessive pressure overshoot and hunting can be avoided.

Figure 2:
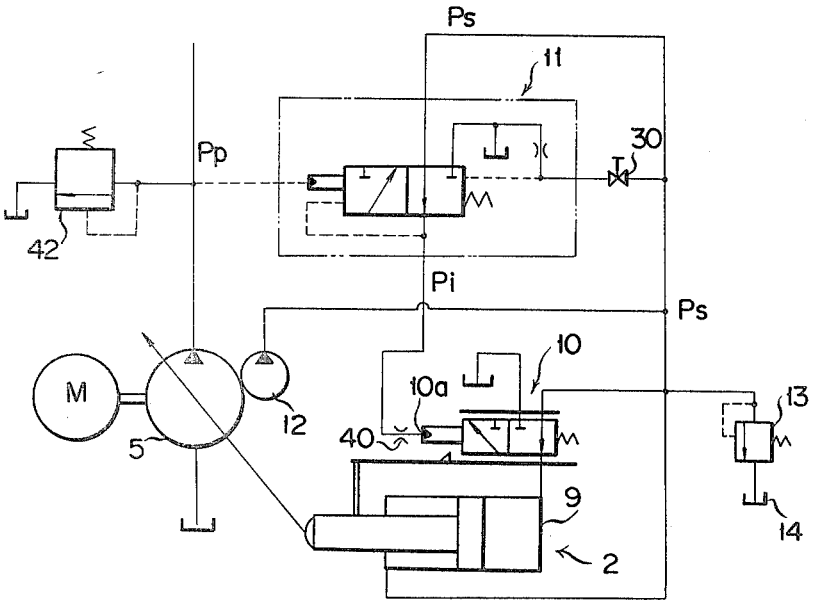
FIG. 2 is a hydraulic circuit of another embodiment of the present invention.
Figure 3:
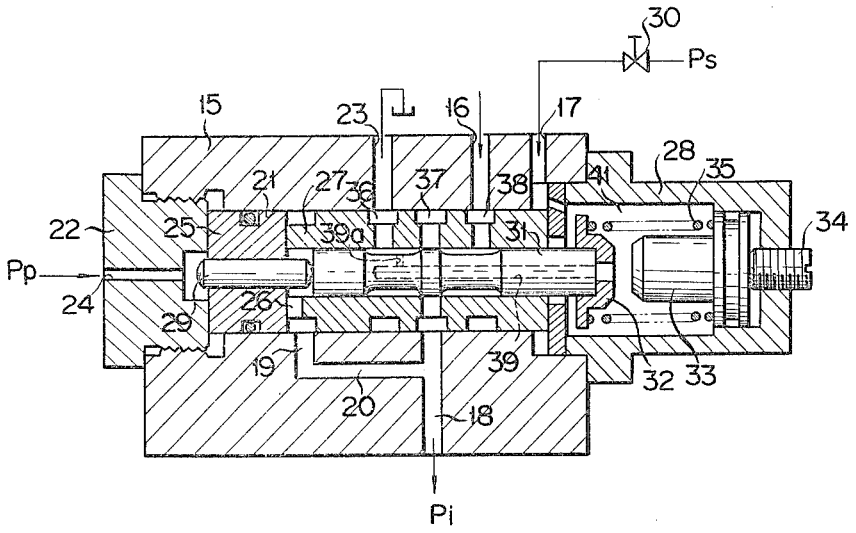
FIG. 3 is a cross-sectional view of a cut-off control valve used in the hydraulic circuit of FIG. 2.

Referring to FIGS. 2 and 3, there is shown another embodiment of the present invention which differs from the embodiment of FIG. 1 in that a warming-up cock 30 is provided on the delivery side of the charge pump 12 and is connected to the port 17 of the cut-off control valve 11. Other structures of this embodiment are same as those of the embodiment of FIG. 1.

Figure 4:
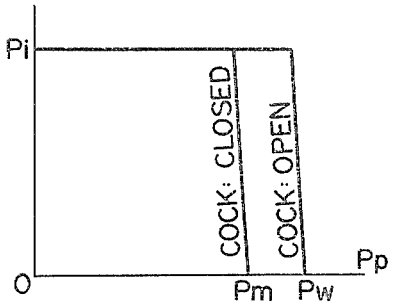
FIG. 4 is a diagram showing characteristic feature of a cut-off control valve wherein Pp is the output pressure of a variable displacement pump and Pi is the output pressure of the cut-off control valve.

FIG. 4 shows a characteristic diagram of the cut-off control valve 11 in which its abscissa shows the pump delivery pressure Pp and its ordinate shows the pilot pressure Pi. When the warming-up cock 30 is closed, the operation of the cut-off control valve of FIG. 3 will be same as that of the control valve of FIG. 1. In brief, when the pump delivery pressure Pp is increased and reaches Pm in FIG. 4, the spool 31 is moved through the pin 29 to the right against the biasing force of the spring 35. As a result, the communication between the ports 16 and 18 is cut off and the port 18 is allowed to communicate with the drain port 23 so that the outlet pressure of the cut-off control valve will decrease. The pressure Pm is determined by the biasing force of the spring 35 preset by the adjusting screw 34.

When the warming-up cock 30 is opened, the charge pressure Ps is introduced into the spring chamber 41, and due to the provision of the restriction 39*a* formed between the passage 39 and the drain port 23, the pressure within the spring chamber 41 will increase up to the charge pressure Ps. Consequently, the force urging the spool 31 leftwards will increase and so Pp will increase to Pw (Pw>Pm) and then move the spool 31 rightwards.

In this case, when the pump delivery pressure Pp reaches Pw, the pilot pressure Pi will decrease.

Since the outside diameter of the spool 31 is larger than that of the pin 29 and the outlet pilot pressure Pi is introduced through the feedback circuit 20 between the spool 31 and the pin 29, when Pi becomes excessively high, the spool 31 is moved rightwards thereby automatically reducing Pi so that automatic pressure compensation can be effected.

Figure 5:
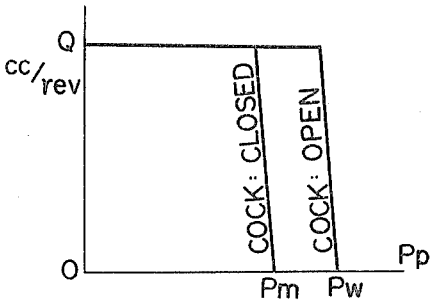
FIG. 5 is a diagram explaining how the cut-off displacement control is performed according to the present invention wherein Pp is the output pressure of a variable displacement pump and Q is the displacement volume thereof.

Since the servo booster 2 controls the displacement volume Q cc/rev of the variable displacement pump 5 in response to the valve of Pi, the cut-off displacement controls of the pump as shown in FIG. 5 can be effected by combining the aforementioned cut-off control valve 11 and the servo booster 2. In FIG. 5, dotted line shows characteristic curve of a main relief valve 42.

If the cracking pressure of the main relief valve 42 is set at Pm and when the warming-up cock 30 is closed, the cut-off displacement controls of the pump is made prior to cracking of the main relief valve 42 and so the energy loss due to the main relief valve 42 can be reduced.

In the case the warming-up cock 30 is opened, cracking of the main relief valve 42 occurs before the cut-off displacement control of the pump is made so that the energy loss due to the main relief valve 42 is increased thereby reducing the time required for warming up the hydraulic system.

Therefore, according to the second embodiment, when warming-up of the hydraulic system is required, the warming-up time can be remarkably reduced by opening the warming-up cock 30, and once the warming-up has been completed, the cut-off displacement control of the pump can be made prior to cracking of the main relief valve 42 by closing the warming-up cock 30 so that the energy loss due to the main relief valve 42 can be reduced.

Figure 6:
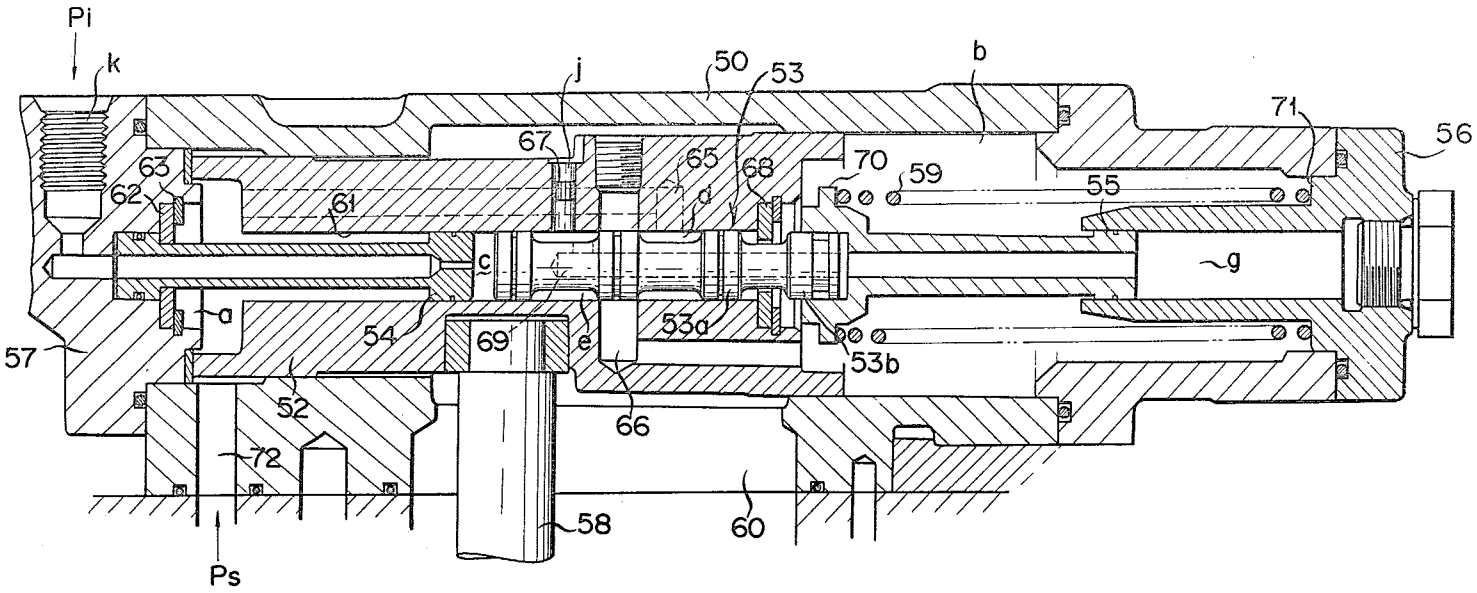
FIG. 6 is a cross-sectional view of a servo booster means.

Referring to FIG. 6, there is shown an embodiment of servo booster 2 adapted to be used in the hydraulic circuit of the present invention.

Reference numeral 50 denotes a servo cylinder in which a servo piston 52 is slidably mounted. Fixedly secured to one end of the servo cylinder 50 is an end cover 57, and also fixedly secured to the other end thereof is a sleeve 56.

The servo cylinder 50 has an axially extending hole 60 formed therein in which servo pin 58 is inserted. The servo pin 58 is fixedly secured to the servo piston 52 (9*a* in FIGS. 1 and 2).

The servo piston 52 has a spool hole 61 formed therein in which a pilot spool 53 and a guide tube 54 are inserted. One end of the guide tube 54 is fixedly secured to an end cover 57 by means of a retainer member 62 and a snap ring 63, and the inside of the guide tube 54 communicates with a port k formed in the end cover 57.

The servo piston 52 has a drain port j extending from the peripheral face and communicating with the spool hole 61, a port 65 communicating with a pressure chamber "a" and a port 66 communicating with a pressure chamber b. A restriction 67 is formed in the drain port j. The servo piston 52 has a stopper 68 located between lands 53*a* and 53*b* of the pilot spool 53.

One end of a slide tube 55 is fitted to an end of the pilot spool 53 and the other end thereof is slidably mounted in the sleeve 56.

The inside of the slide tube 55 communicates with a passage 69 of the pilot spool 53 which opens in the peripheral surface thereof.

Further, the slide tube 55 has a spring seat 70 formed in the other end thereof. A spring 59 is mounted between the spring seat 70 and a spring seat 71 of the sleeve 56.

The aforementioned servo pin 58 is connected to the yoke or swash plate (not shown) of the variable displacement pump 5.

Reference numeral 72 denotes an inlet port for the change pressure Ps.

Thus, charge pressure Ps is supplied through the inlet port 72 into the pressure chamber "a" defined in one end of the servo piston 52. Pilot pressure Pi is supplied by way of the port k into a pressure chamber c defined between the guide tube 54 and the pilot spool 53. A chamber g within the sleeve 56 communicates with the drain port j.

The above-mentioned pressure chamber "a" communicates through a port 65 with a chamber d, and a pressure chamber b formed in the end of the servo piston 52 communicates with the port 66.

With an increase in the pilot pressure Pi, the pilot spool 53 is moved rightwards against the biasing force of the spring 59 so as to allow the port 66 and the drain port j to communicate so that the working fluid within the pressure chamber b is drained through the restriction 67 of the port j and the servo piston 52 will move or follow after the pilot spool 53.

Since the pilot spool 53 is moved rightwards against the biasing force of the spring 59 in response to increase in the pilot pressure, the displacement volume of the pump can be set by the pilot pressure.

When the pilot pressure Pi is suddenly increased, the pressure within the chamber e is increased by the restriction 67 of the drain port j, and the pressure rise is transmitted to the chamber g within the sleeve 56.

Therefore, as the rightward moving speed of the servo piston increases, the force tending to return the pilot spool 53 leftwards will increase thereby limiting the speed of increasing the displacement volume of the pump.

On the contrary, when the pilot pressure Pi is suddenly reduced, the pilot spool 53 is returned or moved leftwards by the force of the spring 59 so as to allow the ports 65 and 66 to communicate so that the charge pressure Ps is supplied into the pressure chamber b and the servo piston 52 will move or follow after the pilot spool 53.

In this case, because the quantity of the fluid passing through the restriction 67 of the drain port j is extremely limited, the pressure within the chamber g of the sleeve 56 is maintained at the drain pressure regardless of the speed of movement of the servo piston 52.

Accordingly, the pilot spool 53 is not subjected to the influence of the servo piston 52 and so the speed of reduction in the displacement volume of the pump is not limited.

When the pump is stopped, the displacement volume of the pump is kept at its minimum by the action of the spring 59.

It is to be understood that the above description is by way of example only, and that details for carrying the invention into effect may be varied without departing from the scope of the invention claimed.

What we claim is:

1. A displacement control system for a variable displacement pump comprising: charge pump means; cut-off control valve means connected to said charge pump means, said cut-off control valve means comprising a valve body having first and second pump ports and first and second outlet ports formed therein, the first pump port being connected to said charge pump means and the second pump port being connected to said variable displacement pump, sleeve means mounted within said valve body, a pin slidably mounted within said sleeve means, a spool slidably mounted within said sleeve means, the cross-sectional area of which is larger than that of said pin, said second outlet port communicated with a chamber formed by said sleeve means, said pin, and one end of said spool, a passage formed in said valve body communicating said first outlet port with said second outlet port, a cylindrical cap member fixedly secured to said valve body defining a spring chamber therein, and spring means disposed within said spring chamber for urging said spool toward connecting said first pump port with said first outlet port; and servo booster means connected to said first outlet port for controlling the displacement of said variable displacement pump.

2. A displacement control system for a variable displacement pump as recited in claim 1 wherein said servo booster means comprises servo pilot-operated spool valve means connected with said first outlet port and operated by the hydraulic fluid therefrom, said servo pilot-operated spool valve means being connected to said charge pump means, and servo cylinder means having a piston mounted therein forming a rod-side chamber and a head-side chamber, the piston being mechanically connected to said variable displacement pump for controlling the displacement therefrom, rod-side chamber of said servo cylinder means being connected to said charge pump means and head-side chamber thereof being connected to said servo pilot-operated spool valve means.

3. A displacement control system for a variable displacement pump as recited in claim 1, or 2 further comprising warming-up cock means connected to said charge pump means at its input side and to said spring chamber of said cut-off control valve means at its output side.

4. A displacement control system for a variable displacement pump as recited in claim 1 wherein said servo booster means comprises servo cylinder means, servo piston means slidably mounted within said servo cylinder means, said servo piston means having a spool hole and a drain port formed therein and being mechanically connected to said variable displacement pump for controlling the displacement therefrom, guide tube means secured to said servo cylinder means at one end thereof, the other end being inserted into the spool hole of said servo piston means, said guide tube means being adapted to introduce the hydraulic fluid from the first outlet port of said cut-off control valve means into the spool hole of said servo piston means, spool means slidably mounted within the spool hole of said servo piston means, said spool means having an axial passage formed therein, sleeve means fixedly secured to said servo cylinder means, said sleeve means being plugged at one end thereof, slide tube means slidably inserted within said sleeve means at one end thereof, the other end of which is engaged with one end of said spool means, the inside of said sleeve means being normally in communication with said drain port through said slide tube means and the axial hole of said spool means, and spring means for urging said slide tube means and said spool means against the hydraulic fluid from the first outlet port of said cut-off control valve means.

5. A displacement control system for a variable displacement pump as recited in claim 4 wherein a restriction is formed at the drain port of said servo piston means.

* * * * *